US005394805A

United States Patent [19]

Giraud et al.

[11] Patent Number: 5,394,805

[45] Date of Patent: Mar. 7, 1995

[54] SABOT FOR PROJECTILES OF RAM ACCELERATORS AND PROJECTILES EQUIPPED WITH SUCH A SABOT

[75] Inventors: Marc Giraud, Saint-Louis La Chaussee; Hubert Simon, Hegenheim, both of France

[73] Assignee: Institut Franco-Allemand De Recherches De Saint-Louis, Saint-Louis Cedex, France

[21] Appl. No.: 115,421

[22] Filed: Sep. 2, 1993

[30] Foreign Application Priority Data

Sep. 16, 1992 [FR] France ..... 92 11033

[51] Int. Cl.[6] ..... F42B 14/06

[52] U.S. Cl. ..... 102/520; 102/513; 102/526; 89/8

[58] Field of Search ..... 102/513, 520–524, 102/526, 527; 89/8

[56] References Cited

U.S. PATENT DOCUMENTS

| | | | |
|---|---|---|---|
| 3,862,603 | 1/1975 | Kornblith et al. . | |
| 4,043,269 | 8/1977 | Ambrosini | 102/523 |
| 4,372,217 | 2/1983 | Kirkendall et al. . | |
| 4,389,939 | 6/1983 | Ofuji | 102/458 |
| 4,823,703 | 4/1989 | Donaldson . | |
| 4,982,647 | 1/1991 | Hertzberg et al. . | |
| 5,052,305 | 10/1991 | Chiarelli et al. | 102/523 |

FOREIGN PATENT DOCUMENTS

| | | |
|---|---|---|
| 1095777 | 2/1981 | Canada . |
| 0095868 | 12/1983 | European Pat. Off. . |
| 0183892 | 6/1986 | European Pat. Off. . |
| 1206606 | 2/1960 | France . |
| 3735481 | 5/1989 | Germany . |
| 2121146 | 12/1983 | United Kingdom . |

OTHER PUBLICATIONS

"The RAM Accelerator and Its' Application: A New Chemical Approach for Reaching Ultrahigh Velocities" by Hertzberg et al.
Invited Paper, Sixteenth International Symposium on Shock Tubes and Waves, Aachen, West Germany, Jul. 26–30, 1987.

*Primary Examiner*—Harold J. Tudor
*Attorney, Agent, or Firm*—Young & Thompson

[57] ABSTRACT

The sabot (16) relates to a projectile (11) which can be accelerated in an accelerator comprising a tubular preaccelerator followed by RAM acceleration tubes. It consists of an outer band (18) which is designed in a way to be attached to the radial fins (13) at the rear of the projectile (11) and to support the peripheral sealing elements (25) and a subcaliber base plate (31) of relatively small thickness, which is designed in such a way that it rests on the outer band (18) with its perimeter, and if necessary on the projectile base (7) with its center part, and that it separates from the projectile (11) and the outer band (18) before the projectile (11) enters into the acceleration tubes.

16 Claims, 4 Drawing Sheets

SABOT FOR PROJECTILES OF RAM ACCELERATORS AND PROJECTILES EQUIPPED WITH SUCH A SABOT

FIELD OF THE INVENTION

The present invention relates to a pusher sabot for a projectile which can be accelerated in an accelerator consisting of a tubular preaccelerator followed by RAM acceleration tubes. This sabot contains sealing elements at its perimeter which are in contact with the inner surface of the preaccelerator and are adapted in such a way that they can transmit the thrust developped in the preaccelerator to the projectile and break away from the projectile if the latter advances after firing from the lower end of the preaccelerator to the entrance of the acceleration tubes.

The invention also relates to a projectile of the above-mentioned type which is equipped with such a sabot.

BACKGROUND OF THE INVENTION

It is well-known that a RAM accelerator is an aero-thermo-chemical device comprising a powder or light-gas preaccelerator which can set the projectile to be fired in motion up to a supersonic velocity. Several tubes are arranged in series in the extension of the preaccelerator which are separated from each other by plastic diaphragms and filled with a reactive gas mixture. This gas mixture is activated during the passage of the projectile so that an additional thrust acts on the projectile.

The main advantage of a RAM accelerator lies in its capacity to impart a high initial velocity at a low acceleration. This is due to the fact that the energy is distributed along the RAM stages instead of being concentrated in the combustion chamber as is general practice in conventional accelerators.

A projectile for RAM accelerators is normally composed of at least two main parts: the projectile itself which shall be accelerated to the desired velocity and its sabot.

The external form of the projectile is designed to the classical aerodynamic rules so as to provide, on the one hand, the equivalent of a well-dimensioned diffuser in the volume between the projectile and the wall of the acceleration tube and, on the other hand, the desired type of flow (e.g. a normal shock wave acting on the boattail of the projectile in the case of a subsonic combustion).

The sabot which has the same diameter as the tube shall satisfy the following conditions to be effective:

In the presence of the projectile to be accelerated it shall withstand the maximum acceleration in the preaccelerator.

It shall contain one or several sealing elements so that the thrust furnished by the preaccelerator can be transmitted without any losses.

As the risk of deterioration of the tube has to be taken into account it shall offer a sufficient guiding length (40% to 60% of the tube's caliber) so that it will neither rotate during its installation nor at the moment the thrust is achieved.

It shall ensure the initiation of the diffuser during the free flow between projectile and tube wall.

The U.S. Pat. No. 4,982,647 describes a sabot which is perforated on both sides by a multitude of orifices with axes parallel to the direction of flow and offering a total flow passage cross section proportional to the free section at the projectile base. During the preacceleration phase the rear of the sabot is closed by a pressure plate or a valve. As soon as the medium in front of the sabot has established a sufficient back pressure the valve is automatically opened, and thus the diffuser is initiated. The tube is no longer plugged. For big calibers and relatively high pressures, this solution presents some problems with the mechanical strength of the sabot, because the latter loses its mechanical strength once it is perforated. The sabot is therefore reinforced in advance, and depending on the material used this may lead to excessive length and additional weight. These unfavourable characteristics may involve a supplementary handicap in the case of subsonic combustion: With regard to the initiation delay they may impede the establishment of an adequate volume between projectile and sabot at the moment of ignition where the combustion can take place. In certain cases the sabot can be solid.

Thus the main reasons for the disadvantages of the known sabots are as follows: their relatively great axial dimension which exceeds 40% of the caliber in the above-mentioned patent, their diameter which is equal to the caliber, and their relatively high weight which may exceed 20% of the projectile weight. All these aspects affect the ballistic performances of the system in an unfavourable way.

SUMMARY OF THE INVENTION

The purpose of the present invention is to eliminate the disadvantages of the known sabots and to propose an improved sabot of the above-mentioned type which will be light, rather inexpensive, of extremely simple structure, easy to use and suitable for the optimum operation of a RAM accelerator.

According to a first embodiment of the invention the sabot of the above-mentioned type is characterized by an outer ring and a subcaliber base plate: The outer band is designed in a way to be fixed to the radial fins at the rear of the projectile and to support the peripheral sealing elements. The subcaliber base plate is designed in such a way that it will rest on the outer band with its periphery, and if necessary on the projectile base with its center part and that it will separate from the projectile and the outer ring at the right moment.

The base plate of the sabot, which according to the invention will rest on the outer ring with its periphery, and if necessary on the projectile base with its center part, will thus be well supported and be able to withstand the thrust generated in the preaccelerator despite its relatively low thickness. This thickness corresponds to a reduction of 60% to 75% as compared to the thickness of the known sabots, i.e. a final thickness in the range of 10% to 24% of the tube's caliber with a preferred value of approximately 15% of the caliber.

Besides, the subcaliber disk can rotate in the acceleration tubes without risking to deteriorate the internal wall of these tubes or to get stuck in the latter. It is therefore no longer obligatory to observe a certain minimum thickness in the axial direction of the projectile to ensure the correct guidance of the sabot as is the case with the known sabots.

Thus the base plate can be light and rather inexpensive.

In addition, it is easy to attach the outer ring to the fins of the projectile and to define this band in such a way that it will not interfere with the functioning of the acceleration tubes.

According to an advantageous embodiment of the invention the outer ring has a double profile presenting in the cross sectional view a reentering profile on the inside directed towards the rear and the inside at an angle of approximately 45° to the projectile axis and a salient profile on the outside directed towards the rear and the outside at an angle of approximately 15° to the projectile axis constituting peripheral sealing elements.

Due to these characteristics the outer ring has only a negligible influence on the functioning of the acceleration tubes.

According to a preferred embodiment of the invention the base plate comprises a body with axial orifices which rests on the rear face of the outer ring, and if necessary on the projectile base before firing, and a removable cover which is placed against the rear face of the body from the opposite side of the projectile.

The sabot of the invention thus provides excellent conditions for the initiation of the diffuser and the ignition of the reactive gas mixture in the acceleration tubes.

According to another embodiment of the invention the projectile of the abovementioned type is characterized by the fact that is comprises a sabot corresponding to the first embodiment of the invention.

BRIEF DESCRIPTION OF THE DRAWINGS

Other characteristic features and advantages of the invention will become evident in the course of the following description of the different embodiments of the invention which will be given without claiming completeness and with reference to the enclosed drawings:

DETAILED DESCRIPTION OF THE INVENTION

Figure 1:
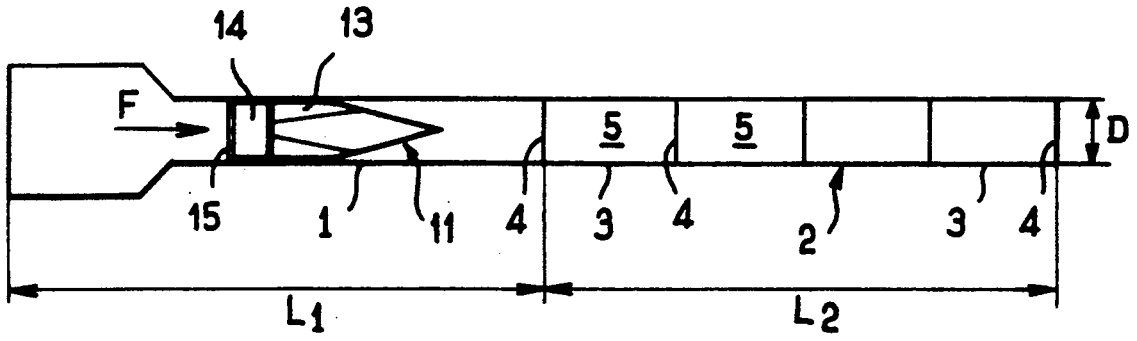
FIG. 1 shows the basic diagram of a RAM accelerator of a known type comprising a projectile of a known type.
Figure 2:
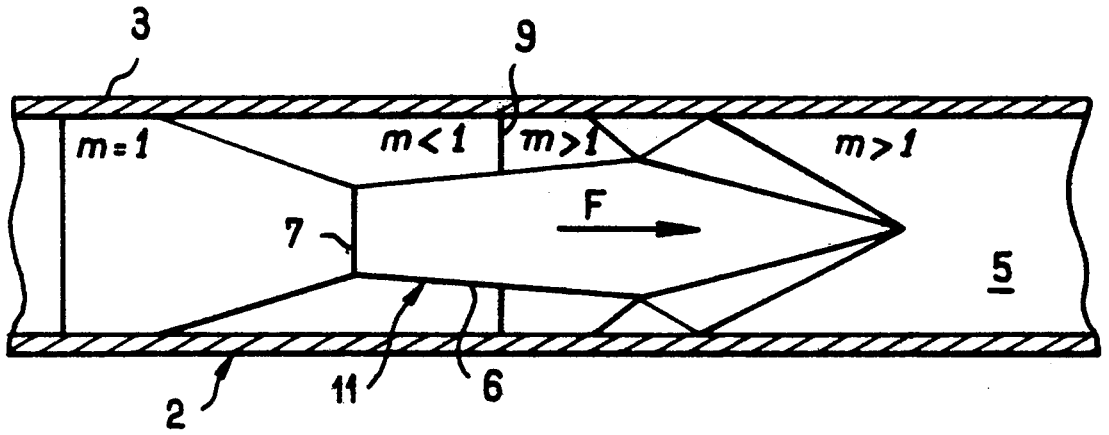
FIGS. 2 and 3 are elevation drawings, partially showing a cross section, which illustrate the operating principle of the RAM portion of the known accelerator shown in FIG. 1 in the subsonic and the supersonic combustion mode, respectively.
Figure 3:
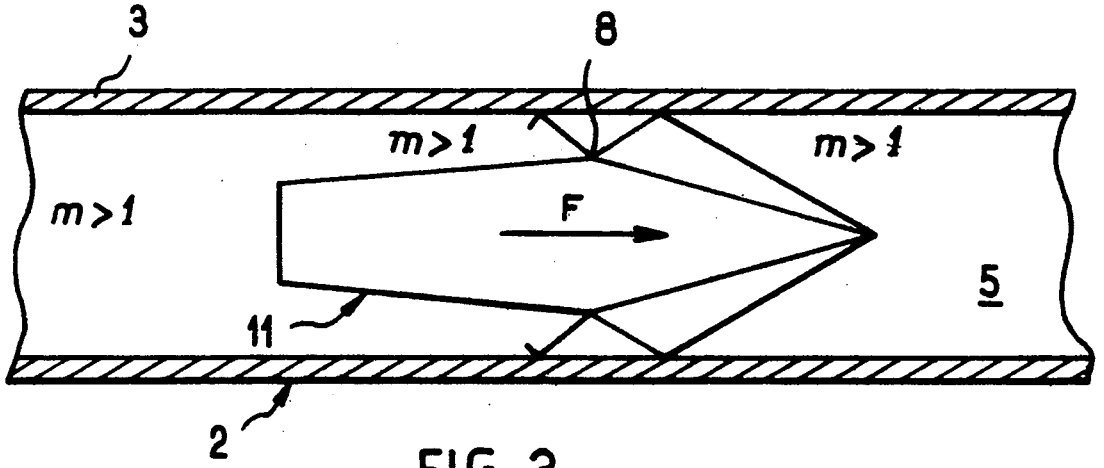

The diagrams in FIGS. 1 to 3 are intended to recall the known operating principles of a RAM accelerator.

Such an accelerator generally comprises a preaccelerator 1 of length L1 followed by the actual RAM accelerator 2 of length L2.

A projectile 11 with a fin assembly 13 advances into the preaccelerator 1 in the direction of the arrow F driven by a removable sabot 14 which is equipped with a sealing element 15. The tubular part in front of the preaccelerator 1 has a diameter D which is equal to the caliber of the projectile to be fired and to the common diameter of the tubes 3 arranged in series and constituting the actual accelerator 2.

The tubes 3 contain a reactive gas mixture 5, as for example methane, oxygen and diluent, and are separated from each other by plastic diaphragms 4 of appropriate thickness.

Figure 4:
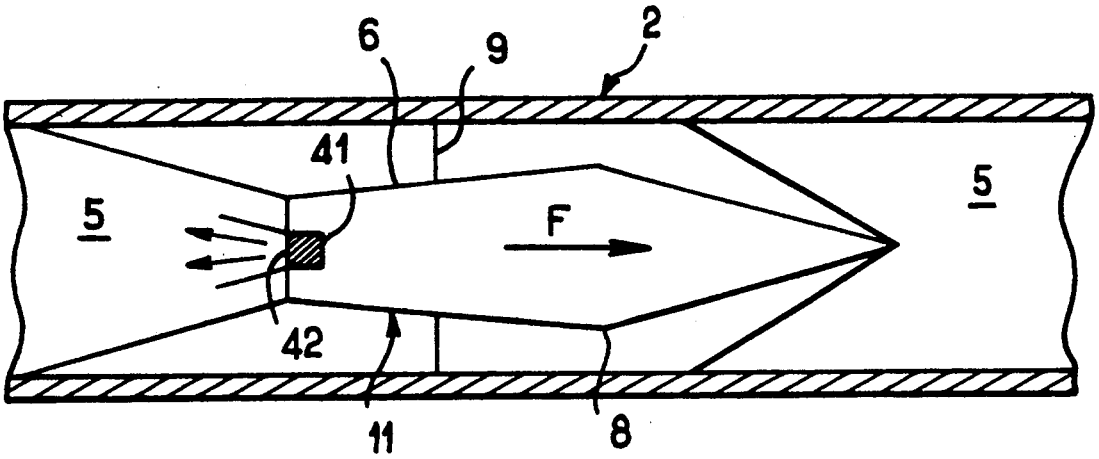
FIG. 4 presents a view similar to that of FIGS. 2 and 3 showing a projectile with a tracer at its base to initiate the reactive gas mixture in the acceleration tubes.
Figure 5:
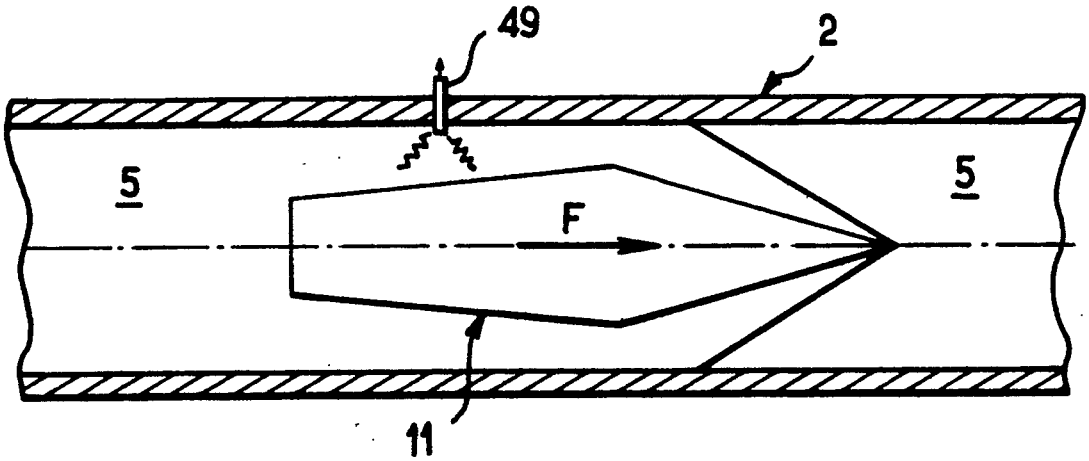
FIG. 5 presents a view similar to that of FIG. 4 with the reactive gas mixture being initiated by an external device (igniter plug).

For reasons of simplification the fin assembly 13, which serves to guide the projectile in the preaccelerator 1 and in the accelerator 2, is neither shown in FIGS. 2 and 3 nor in FIGS. 4 and 5.

As mentioned earlier the sabot 14 shall receive the preacceleration thrust, transmit it to the projectile 11 and then separate from the projectile before the latter penetrates into the acceleration tubes 3.

By means of a powder or light-gas preaccelerator 1 it is possible to set the projectile in motion so that it attains a supersonic velocity between 1000 m/s (Mach 3) and 2000 m/s (Mach 6).

As soon as the projectile 11 has penetrated the reactive medium (see FIG. 2) it will receive an additional thrust which is generated by the combustion of this medium and acts upon the boattail 6 or the base 7 or on both.

The above example describes the subsonic combustion with a shock wave surface 9 separating two regions where the Mach number m is either below or above Mach 1 and with a thermal blocking area ($m=1$) behind the projectile.

In the case of the other main type of combustion, i.e., the supersonic combustion ($m>1$) (see FIG. 3), the thrust acts mainly in the vicinity and behind the maximum diameter 8 of the projectile.

Regardless of the type of combustion the reactive gas mixture can easily be ignited.

FIG. 4 shows a projectile corresponding to the invention whose base is equipped with a tracer 41 containing a pyrotechnical compound. In the case of a subsonic combustion this compound serves as a quasi permanent source to provoke the ignition of the reactive gas mixture 5 by an external process.

After having been initiated by the gases of the powder preaccelerator the tracer 41 ignites the reactive medium 5 with which it is connected via an axial hole 42 in the projectile base.

If a projectile is equipped with such a tracer 41 at its base, a base plate with an axial hole 43 can be used through which the jet of the tracer 41 can pass. This will be described below. The tracer or pyrotechnical compound can in any case facilitate the opening of the valve 34.

The external ignition of the reactive gas mixture can also be provoked by means of an ignition device 49 such as an igniter plug (see FIG. 5), this device being suited regardless of the type of combustion (subsonic or supersonic).

The subsonic combustion should be stabilized at the rear of the projectile (main flame front in the rear subsonic area) so that the additional acceleration owing to the RAM effect can develop. This requires the perfect control and synchronization of the following three events:

initiation of the diffuser or free flow between projectile and tube wall;

ignition of the reactive gas mixture at the rear of the projectile;

availability of an adequate volume between projectile and sabot at the moment of ignition so that the combustion can take place there.

For the supersonic combustion it is sufficient to synchronize the first two events only: after the indispensable initiation of the diffuser, the ignition of the reactive gas mixture starts near the "throat" behind the reflected shock wave.

As far as the third event is concerned, i.e. the availability of an adequate volume between the projectile base and the front surface of the sabot at the moment of ignition to enable the subsonic combustion, it can be stated that this volume expands with the acceleration of the projectile and the deceleration of the sabot, with the latter being directly proportional to the weight of the sabot.

The external form of the projectile is designed in such a way that it offers, on the one hand, the equivalent of a well-dimensioned diffuser in the volume between the projectile and the wall of the acceleration tube and, on the other hand, an appropriate type of flow, for example by generating a normal shock wave (9, see FIG. 2) which acts on the boattail of the projectile in the case of a subsonic combustion.

The explanations given above underline the importance attached to the sabot in the process of firing the actual projectile, as the sabot does not only affect this process because of its mass (inertia of the fired system) and due to the fact that it serves as a guiding device (in the first phase of acceleration), but also influences the process of diffuser initiation.

Figure 6:
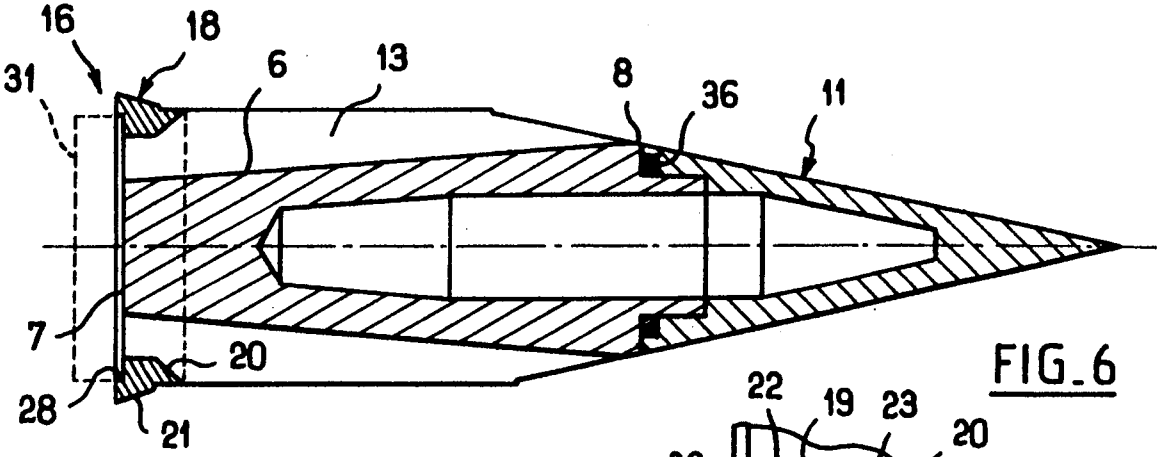
FIG. 6 shows the longitudinal section and FIG. 7 the rearside elevation of a projectile and a sabot corresponding to the invention with the base plate being removed.
Figure 10:
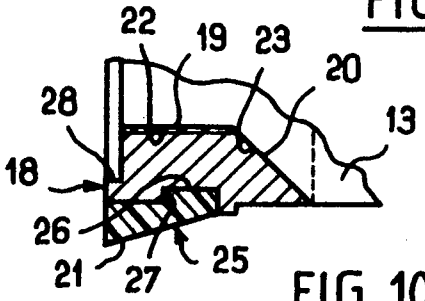
FIG. 10 shows an enlarged view of a detail of FIGS. 6 and 8.
Figure 7:
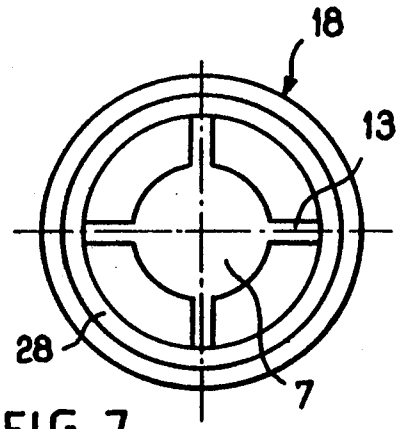
Figure 9:
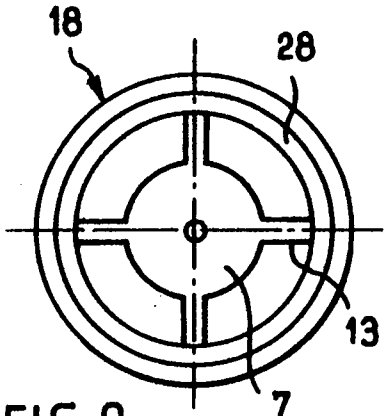

FIGS. 6, 7 and 10 represent a first embodiment of the invention.

The projectile 11 is stabilized by the fin assembly 13 which is designed in such a way as to accept a sabot 16 corresponding to the invention. The sabot 16 comprises an outer band 18 made of resistant light alloy whose internal profile presents in the axial plane a cylindrical tail section 19 and a flared forward section 20. This profile with a reentering angle shall facilitate the flow of the gases in the tubes 3 of the RAM stage.

The value of the reentering angle measured in the axial plane ranges from 10° to 60° with a preferential value of approximately 45°.

In addition, the net clearance at the level of the outer ring shall be greater or equal to the clearance around the projectile at the level of its maximum diameter (8) (base of the front cone).

To ensure the peripheral tightness of the sabot 16 with respect to the gases of the preaccelerator the outer ring 18 has also an external profile defined by an annular sealing 25 forming a salient angle, i.e. it presents a conical surface which is directed towards the outside and the rear. The value of this angle is lower than the value of the above-mentioned reentering angle. It ranges between 10° and 20° with a preferred value of approximately 15°. The sealing 25 is held by an internal annular ridge 26 which engages in a groove 27 in the outer ring 18.

The fins 13 are designed at the projectile base in such a way that their form 22, 23 is adapted to the internal annular surface 19, 20 of the sabot. Thus this shape comprises a cylindrical surface 22 having the same radius and length as the cylindrical surface 19 and a conical surface 23 corresponding to the conical surface 20. Besides, the outer ring 18 is connected tightly to the projectile by press fitting. Consequently this ring shall be designed in such a way that it has minimum impact on the aerodynamics of the projectile during its flight. In this context it is appropriate to compare this configuration with certain known projectile configurations operating at subsonic velocities (e.g. airborne bombs) where the projectile fins are surrounded with a ring or a tube in order to produce aerodynamic effects (stabilization of the projectile).

Figure 8:
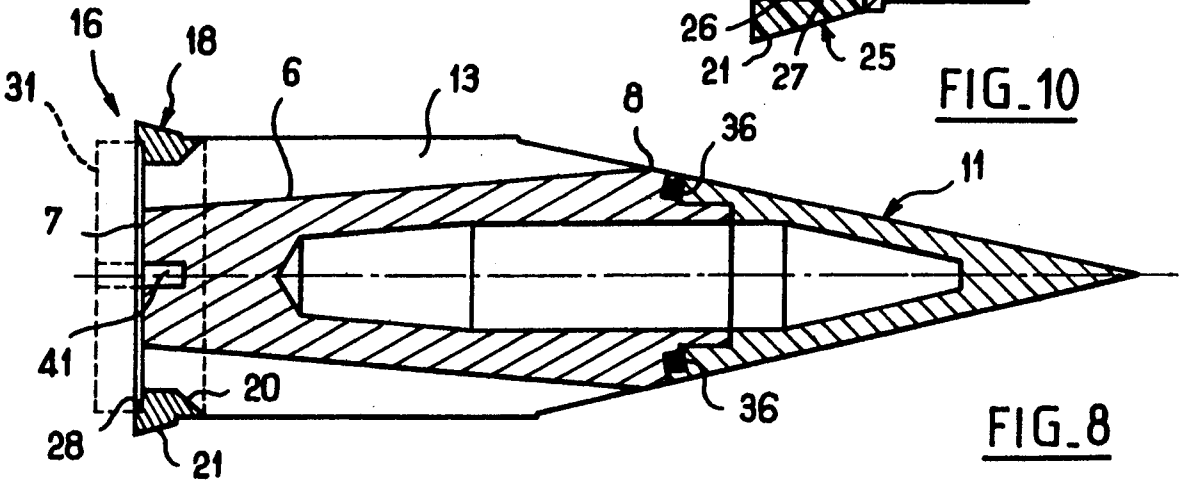
FIGS. 8 and 9 present views similar to those in FIGS. 6 and 7 showing a projectile with a tracer attached to its base.

The outer ring has a cutout 28 on its rear face (see FIG. 10) to hold a removable subcaliber base plate 31, for example one of the plates shown in FIGS. 11 to 19. The location of the base plate 31 is indicated by a dashed line in FIGS. 6 and 8.

Figure 11:
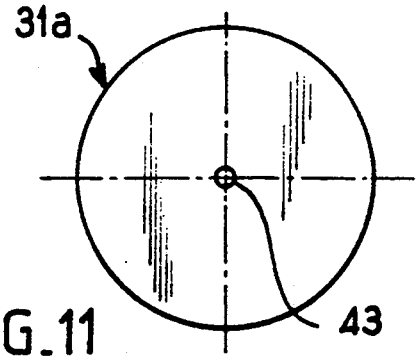
FIG. 11 shows an elevation and FIG. 12 an axial section of a base plate consisting of only one part and corresponding to a first embodiment of the invention.
Figure 12:
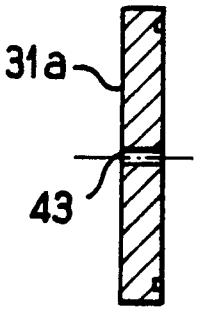

In the embodiment shown in FIGS. 11 and 12 the subcaliber base plate **31*a* is a solid disk. It contains a hole 43 in the center if the projectile 11 is equipped with a tracer 41**.

Figure 15:
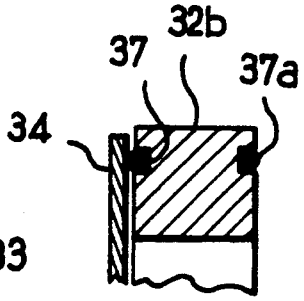
FIG. 15 shows an enlarged view of a detail of FIG. 14.
Figure 13:
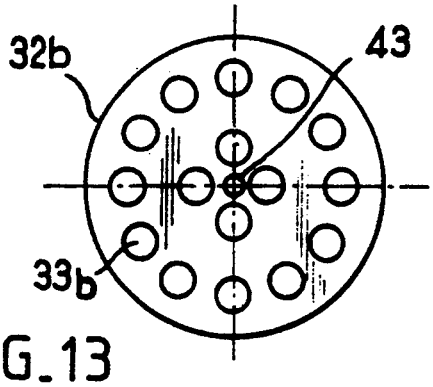
FIGS. 13 and 14 present views similar to those in FIGS. 11 and 12 showing a base plate consisting of two parts and corresponding to another embodiment of the invention.
Figure 14:
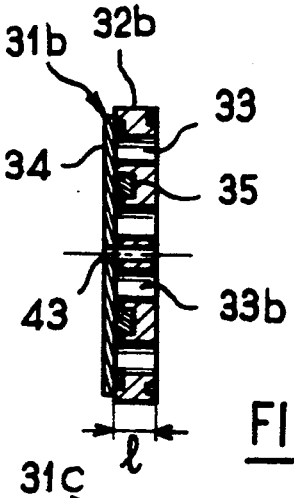

Another embodiment of the base plate corresponding to the invention is shown in FIGS. 13 to 15.

In this case the base plate **31*b* consists of two parts and is therefore designated here a dual obturator disk. One part is a disk-shaped and relatively thick body 32*b* with a thickness 1 and made of ZICRAL alloy (AZ 8GU) for example. The disk contains axial holes 33** of the diameter d whose role will be described below.

The disk **32*b* also contains a magnetic ring 35. This ring and the magnetic flux detectors, which are attached to the accelerator tube wall in a known manner and therefore not shown here, are used to recover the disk's trajectory with reference to the trajectory of the projectile, which is also equipped with a magnetic ring 36** of the same type.

A thin obturating plate 34 designated valve and made of dural (AU4G) for example is attached to the rear face of the disk **32*b* and constitutes the second part of the dual obturator disk 31*b***.

As shown in detail in FIG. 15 there is a sealing ring 37 between the peripheral parts of the obturating plate 34 and the thick disk **32*b*, and a second sealing ring 37*a* is fitted between the corresponding peripheral parts of the thick disk 32*b* and the cutout 28 at the rear of the outer ring 18. The sealing rings 37 and 37*a*** are especially useful during vacuum generation in the preaccelerator prior to the firing of the projectile.

Figure 16:
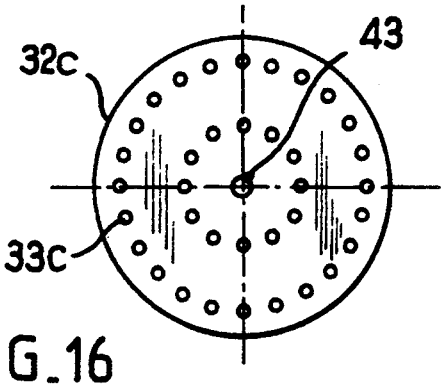
FIGS. 16 and 17 present views similar to those in FIGS. 13 and 14 showing another embodiment of a base plate which corresponds to the invention.
Figure 17:
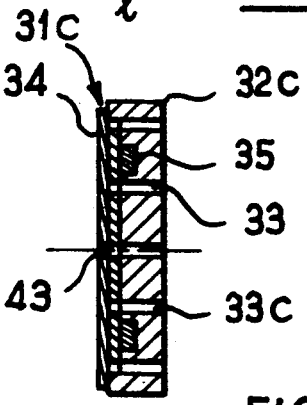
Figure 18:
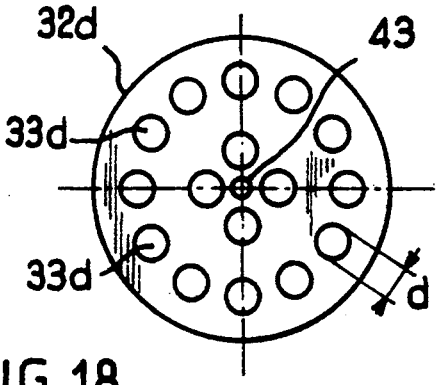
FIGS. 18 and 19 present views similar to those in FIGS. 13 and 14 showing another embodiment of a base plate which corresponds to the invention.
Figure 19:
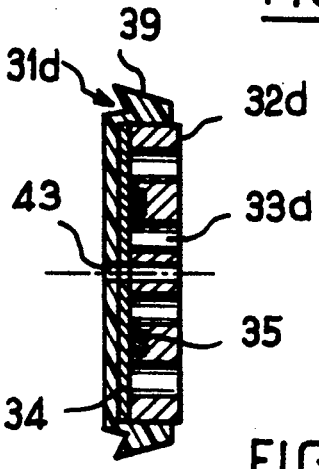

FIGS. 16 and 17 show a first variant of the dual obturator disk **31*c* differing from the disk shown in FIGS. 13 to 15 mainly in its greater number of holes 33*c* in disk 32*c* and in the smaller diameter of these holes compared with the holes 33*b***.

A second variant of the dual obturator disk **31*d* (FIGS. 18 and 19) comprises an additional sealing 39** which is of the same type as the sealing of the outer ring 18.

The holes 33*d* of disk 32*d* are identical in size and number with the holes 33*b* of disk 32*b*. However, disk 32*d* is thicker than disk 32*b* and therefore the value representing the ratio 1/d is higher for disk 32*d*. This will be explained below in more detail.

The operation of the sabot corresponding to the invention can be derived from the preceding description.

The projectile 11 and its sabot 16 being in place in the preaccelerator 1 (e.g. a powder preaccelerator), one can proceed to the ignition. The combustion gases exert high pressure on the sabot 16 and especially on its obturator disk 31, 31*a*, 31*b*, 31*c*, 31*d*. This sets the system consisting of sabot and projectile in a rapid motion so that it penetrates into the tubes of the RAM stage.

The initiation of the reactive gas mixture in the tubes 3 can easily be achieved by a so-called natural process or an initiation by shock wave: The conditions within the medium are adequate to initiate the gas mixture either at the rear of the projectile (subsonic combustion) or behind the reflected shock wave (supersonic combustion). The initiation can also be provoked by an external process as described above with reference to FIGS. 4 and 5.

As soon as a back pressure has been established at the projectile the solid base plate 31*a* or the obturating plate 34 of the dual disks 31*b*, 31*c*, 31*d* will be ejected and separated from the projectile 11. Due to the holes 33*b*, 33*c*, 33*d* in the relatively thick disk 32*b*, 32*c*, 32*d* or due to the separation of the solid disk 31*a*, a flow can immediately pass through the sabot and provoke the initiation of the diffuser without delay. The aerodynamic efficiency of the holes depends on the ratio 1/d. Their efficiency increases if the ratio decreases. According to the present embodiments of this invention this ratio can assume values between 0.7 (FIGS. 13 to 15) and approximately 3 (FIGS. 16 and 17). The values of conventional perforated sabots are far less favorable since they range between 3 and 5. This is an essential difference.

Of course the invention is not limited to the examples described in this specification and numerous modifications could be proposed without leaving the scope of this invention.

We claim:

1. A pusher sabot for a projectile to be propelled through an accelerator tube including a plurality of end connected tubular sections, a first and a second series of sections consisting respectively of a preaccelerator tube and RAM accelerator tubes, said sabot having an outer periphery portion and at least one sealing element secured thereto, said at least one sealing element comprising an outer surface, said sabot adapted to be accommodated within said preaccelerator tube, said preaccelerator tube having an inner surface in contact with said outer surface of the at least one sealing element when said sabot is in the preaccelerator tube, means for developing a thrust in said preaccelerator tube, said at least one sealing element comprising means for transmitting said thrust to the projectile, said at least one sealing element separating from said sabot when the projectile advances over a connection between the preaccelerator tube and the RAM accelerator tubes, after firing when the projectile is propelled through the preaccelerator and RAM accelerator tubes successively, said sabot further comprising an outer peripheral ring and a subcaliber base plate, the projectile including an aft body portion from which fins radially extend, an inner surface of said outer peripheral ring and an aft outer portion of the fins comprising securing means for securing the fins to said outer ring, said outer ring including anchorage means at its outer periphery, said at least one sealing element being secured to the outer ring by said anchorage means, said outer ring having a central bore with an outer portion defining a shoulder and in which said subcaliber base plate is partly embedded, and wherein at least a portion of the subcaliber base plate is constructed and arranged to separate from the projectile and from the outer ring at a predetermined time.

2. The pusher sabot as recited in claim 1, wherein the subcaliber base plate has a thickness ranging between 10% and 24% of the accelerator tube's caliber.

3. The pusher sabot as recited in claim 2, wherein the thickness of the base plate is about 15% of the accelerator tube's caliber.

4. The pusher sabot as recited in claim 1, wherein said outer ring has a profile presenting in a cross-sectional view a reentering profile on the inside directed towards the rear and the inside, and an outer salient profile directed towards the rear and the outside constituting the at least one sealing element.

5. The pusher sabot as recited in claim 4, wherein the reentering profile of the outer ring of the sabot forms an angle of 10° to 60° , measured in the axial plane with respect to the projectile axis.

6. The pusher sabot as recited in claim 5, wherein said reentering profile forms an angle of approximately 45° with respect to the projectile axis.

7. The pusher sabot as recited in claim 4, wherein said salient profile forms an angle of 10° to 20° in the axial plane with respect to the projectile axis.

8. The pusher sabot as recited in claim 7, wherein said salient profile forms an angle of approximately 15°.

9. The pusher sabot as recited in claim 4, wherein said at least one sealing element is annular.

10. The pusher sabot as recited in claim 1, wherein said base plate is solid.

11. The pusher sabot as recited in claim 1, wherein a middle portion of the base plate contacts an aft radial surface of said projectile, and said aft radial surface of the projectile has an initiation device consisting of a pyrotechnical device which is initiated by gases of the preaccelerator tubes, said pyrotechnical device including means for initiating a gas mixture, and said base plate comprises an obturator disk having an axial hole for passing a jet of the pyrotechnical device therethrough.

12. The pusher sabot as recited in claim 1, wherein the subcaliber base plate comprises a sealing ring between said base plate and said outer ring.

13. The pusher sabot as recited in claim 1, wherein the base plate comprises a disk-shaped body with axial holes and a removable obturating plate, said disk-shaped body resting on a rear face of the outer ring, and said obturating plate resting on a rear face of said disk-shaped body on the side opposite to the projectile.

14. The pusher sabot as recited in claim 13, further including a sealing ring disposed between the disk-shaped body and the obturating plate.

15. The pusher sabot as recited in claim 13, further comprising a magnetic ring axially installed on the disk-shaped body.

16. A projectile to be accelerated by a RAM accelerator and having radially extending guiding fins for locating the projectile during its installation in said accelerator, said projectile being equipped with a sabot having an outer periphery portion and at least one sealing element secured thereto, said at least one sealing element comprising an outer surface, said sabot adapted to be accommodated within a preaccelerator tube, having an inner surface in contact with said outer surface of the at least one sealing element when said sabot is in the accelerator, means for developing a thrust in said preaccelerator tube, said at least one sealing element comprising means for transmitting said thrust to the projectile, said at least one sealing element separating from said sabot when the projectile advances between the preaccelerator tube and the RAM accelerator, after firing when the projectile is propelled through the preaccelerator tube and the RAM accelerator successively, said sabot further comprising an outer peripheral ring and a subcaliber base plate, an inner surface of said outer peripheral ring and an aft outer portion of the fins comprising securing means for securing the fins to said outer ring, said outer ring including anchorage means at its outer periphery, said at least one sealing element being secured to the outer ring by said anchorage means, said outer ring having a central bore with an outer portion defining a shoulder and in which said subcaliber base plate is partly embedded, and wherein the subcaliber base plate is constructed and arranged to separate from the projectile and from the outer ring at a predetermined time.

* * * * *